US008152993B2

(12) United States Patent
De Haan et al.

(10) Patent No.: US 8,152,993 B2
(45) Date of Patent: Apr. 10, 2012

(54) ETHYLENE FURNACE RADIANT COIL DECOKING METHOD

(75) Inventors: Stephen De Haan, Wayne, NJ (US); Barbara Stancato, Morris Plains, NJ (US); Brian K. Sullivan, Lafayette, NJ (US); Charles E. Nagy, Succasunna, NJ (US); Frank McCarthy, Wayne, NJ (US)

(73) Assignee: Lummus Technology Inc., Bloomfield, NJ (US)

( * ) Notice: Subject to any disclaimer, the term of this patent is extended or adjusted under 35 U.S.C. 154(b) by 691 days.

(21) Appl. No.: 12/116,689

(22) Filed: May 7, 2008

(65) Prior Publication Data

US 2009/0020459 A1 Jan. 22, 2009

Related U.S. Application Data

(60) Provisional application No. 60/928,093, filed on May 7, 2007.

(51) Int. Cl.
*C10G 9/16* (2006.01)

(52) U.S. Cl. ..... 208/48 R; 208/48 Q; 134/39; 585/650; 585/652

(58) Field of Classification Search ..... 208/48 R, 208/48 Q; 134/39; 585/648, 650, 652
See application file for complete search history.

(56) References Cited

U.S. PATENT DOCUMENTS

| | | | | |
|---|---|---|---|---|
| 4,134,926 | A | 1/1979 | Tsao et al. | |
| 5,446,229 | A | 8/1995 | Taylor et al. | |
| 5,446,299 | A | 8/1995 | Taylor et al. | |
| 6,187,147 | B1 * | 2/2001 | Doerksen | 202/99 |
| 6,877,555 | B2 | 4/2005 | Karanikas et al. | |
| 7,135,602 | B1 | 11/2006 | Le Van Mao | |
| 2005/0261532 | A1 * | 11/2005 | Stell et al. | 585/648 |

FOREIGN PATENT DOCUMENTS

| | | | |
|---|---|---|---|
| EP | 0 591 856 | A1 | 4/1994 |
| EP | 0591856 | A1 | 4/1994 |

OTHER PUBLICATIONS

PCT/IB/326; International Preliminary Report on Patentability; Written Opinion of the International Searching Authority dated Nov. 19, 2009.

International Search Report and Written Opinion of the International Searching Authority for International Application No. PCT/US2008/62906.

Written Opinion dated Apr. 15, 2010 in corresponding Singapore patent application No. 2009073784 (9 pages).

* cited by examiner

*Primary Examiner* — Walter D Griffin
*Assistant Examiner* — Renee E Robinson
(74) *Attorney, Agent, or Firm* — Osha • Liang LLP

(57) ABSTRACT

Methods are provided for decoking the radiant coils in an ethylene cracking plant. The decoking process is controlled by monitoring the coil outlet temperature to control the rate of burning of coke in the radiant coils. Air flow rates, steam flow rates and coil outlet temperatures are controlled during the decoking process to prevent tube damage, minimize decoking time and maximize coke removal.

14 Claims, 1 Drawing Sheet

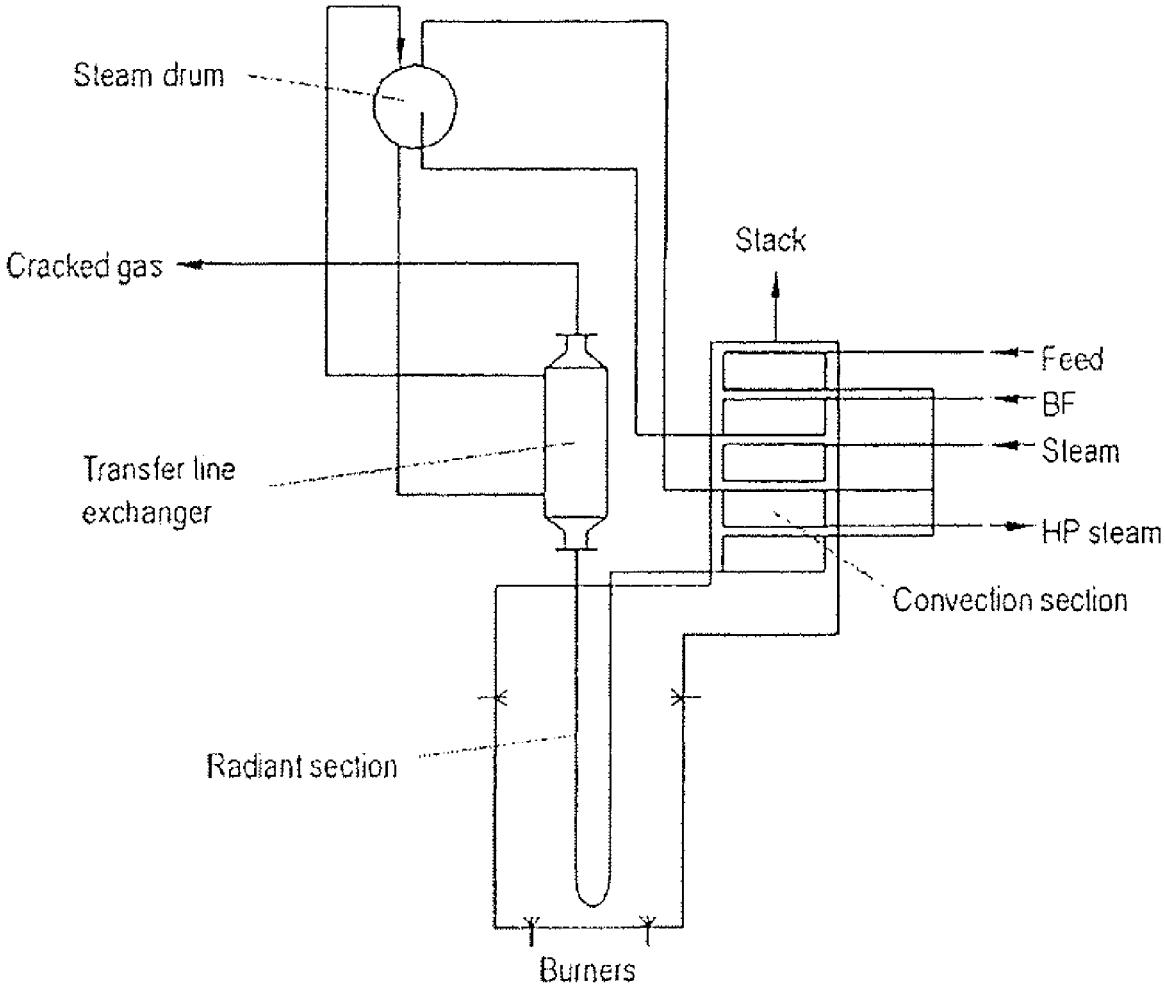
Steam drum
Cracked gas
Stack
Feed
BF
Steam
HP steam
Transfer line exchanger
Convection section
Radiant section
Burners

ETHYLENE FURNACE RADIANT COIL DECOKING METHOD

This application claims the benefit under 35 U.S.C. §119 of U.S. Provisional Application No. 60/928,093 filed on May 7, 2007, the entire contents of which are hereby incorporated by reference.

FIELD OF THE INVENTION

The present invention relates to a method for decoking an ethylene plant furnace. The beginning of the decoking process is controlled using the changes in coil outlet temperature. Air flow rates, steam flow rates and coil outlet temperatures are controlled during the decoking process to prevent tube damage, minimize decoking time and maximize coke removal.

BACKGROUND OF THE INVENTION

Ethylene is produced worldwide in large quantities, primarily for use as a chemical building block for other materials. Ethylene emerged as a large volume intermediate product in the 1940s when oil and chemical producing companies began separating ethylene from refinery waste gas or producing ethylene from ethane obtained from refinery byproduct streams and from natural gas.

Most ethylene is produced by thermal cracking of hydrocarbon with steam. The arrangement of a typical ethylene cracking furnace is shown in FIG. 1. Hydrocarbon cracking generally occurs in fired tubular reactors in the radiant section of the furnace. In a convection section, a hydrocarbon stream may be preheated by heat exchange with flue gas from the furnace burners, and further heated using steam to raise the temperature to incipient cracking temperatures, typically 500-680° C. depending on the feedstock.

After preheating, the feed stream enters the radiant section of the furnace in tubes referred to herein as radiant coils. It should be understood that the method described and claimed can be performed in ethylene cracking furnaces having any type of radiant coils. In the radiant coils, the hydrocarbon stream is heated under controlled residence time, temperature and pressure, typically to temperatures in the range of about 780-895° C. for a short time period. The hydrocarbons in the feed stream are cracked into smaller molecules, including ethylene and other olefins. The cracked products are then separated into the desired products using various separation or chemical-treatment steps.

Various byproducts are formed during the cracking process. Among the byproducts formed is coke, which can deposit on the surfaces of the tubes in the furnace. Coking of the radiant coils reduces heat transfer and the efficiency of the cracking process as well as increasing the coil pressure drop. Therefore, periodically, a limit is reached and decoking of the furnace coils is required.

Decoking of ethylene furnaces is typically conducted every 20 to 70 days. Because the decoking process is generally difficult to monitor, prior decoking procedures are accomplished by ramping air and steam flows at historically acceptable values based upon experience. Using these procedures, it can be difficult to control the coke burn rate. It is also difficult to detect conditions that require a slower more conservative decoke procedure (slower ramping of air rate). This can result in damage to the radiant coils or an undesirably slow decoking, increasing furnace down time and reducing production.

For example, to avoid damage to the radiant coils, some more conservative decoking procedures utilize low air and steam flow rates and flow ramping rates at the beginning of the decoking procedure to avoid fast coke burn. These more conservative procedures can lead to increased down time and lost production. On the other hand, air and steam flow rates and flow ramp rates that are too fast can cause coil erosion or localized fast burning, which can damage the radiant coils.

When air is first introduced to the furnace to start the burning of the coke, overheating of the radiant coils can occur causing a reduction in coil life. Control of the initial air introduction step is difficult because no direct measurement of the coke burning rate is available. To avoid coil damage, this step generally is performed very slowly, which can unnecessarily extend the time for the decoking process.

One effort to address this problem involves the use of effluent analyzers to monitor $CO_2$ formation in the coke burning process. These analyzers generally do not work well at the start of the decoking process due to the relatively small amounts of $CO_2$ present. In addition, the $CO_2$ analysis can be difficult to interpret because it is actually a measure of the percentage of air that is consumed rather than the burn rate of the coke.

Coke spalling prior to decoking is also a concern. Coke can spall from coils due to process upsets immediately prior to decoking and collect in the radiant coils. This material burns very easily, and, as a result, areas of the tubes can be overheated. Coke spalling can be difficult to detect by the methods currently used, which are typically either visual inspection or by measuring coil pressure drop.

Accordingly, it would be desirable to have a method for decoking an ethylene furnace that allowed improved control to reduce the time for the decoking process and to avoid or reduce damage to radiant coils.

SUMMARY OF THE INVENTION

The present invention is a method for controlling the decoking process using changes in the coil outlet temperature (COT). Steam and air flows to the radiant coils in the furnace are controlled to maintain the COT at predetermined levels. The steam and air flows and COTs are maintained at the predetermined levels for sufficient time to allow coke on the radiant tubes to be burned. By monitoring the average and individual coil COTs, as well as the steam and air flow rates, a more efficient controlled burn of the coke can be achieved. The air flow, steam flow and coil temperatures are controlled until $CO_2$ levels in the effluent gas from the radiant coils is below 0.1% by volume or the lower limit of detection of the analyzer or other analysis method.

Among the advantages of the methods of the present invention are a more rapid decoking process and improved control of the decoking process to avoid or reduce radiant coil damage. Other advantages of the method will be apparent to those skilled in the art based upon the description of preferred embodiments described below.

BRIEF DESCRIPTION OF THE FIGURES

FIG. 1 shows a schematic of a typical ethylene cracking plant.

DETAILED DESCRIPTION OF PREFERRED EMBODIMENTS

The present invention is directed to a method for decoking an ethylene cracking furnace. The method generally involves introduction of air and steam to the radiant coils in the furnace, and heating the coils while monitoring the coil outlet temperature (COT) of the coils in the furnace. Using changes in the COTs for the radiant coils to control the decoking process improves the control of the process, thereby reducing decoking times and reducing or eliminating damage to the coils in the furnace. The following description of the process may be used in any ethylene cracking furnace. Specific flow and temperature parameters will be determined by plant operators for a particular furnace based upon operating experience, run lengths, feedstock characteristics, severity of the operation of the plant, and other variables. Typical parameters for decoking an ethylene furnace are provided in Examples 1 and 2 below.

Generally, the method of the present invention comprises providing steam to the radiant coils in the ethylene furnace and heating the radiant coils using the furnace burners to achieve a predetermined average COT. The fuel flow to the furnace and the air damper position are then fixed using a heat input controller to maintain the average COT at the predetermined temperature.

Holding the burner firing rate constant and steam flow rate constant, decoking air flow is then provided to the radiant coils. Decoking air is added to each coil while observing the COT for each coil. The decoking air rate is adjusted to achieve a predetermined increase in the COT of one or more coils. The increase in COT that is observed when air flow begins is a result of the start of coke burning in the coils, as the steam flow and burner firing are held constant.

The temperature of the radiant coil is maintained at the predetermined temperature for a period of time, typically about one hour. The air flow rate is adjusted as needed to maintain the coil at the predetermined COT while maintaining the steam flow rate and burner firing rate constant.

The air flow rate to the radiant coils is again increased and air flow rate is adjusted to achieve a predetermined higher COT in the radiant coil. The COT of the radiant coil is maintained at approximately the predetermined COT for a predetermined period of time.

The airflow rate required to achieve the higher predetermined COT in the hottest coil is then compared to a calculated theoretical minimum as described above to determine if spalled coke is present in the tubes. If spalled coke is detected, the furnace is maintained at the then current COT by holding or increasing air flow rate. Once the air flow rate reaches about 300% of the theoretical minimum, the next step is begun. As described in Example 1 below, the steam and air flow rate are then used to calculate the heat released by burning coke and the amount of coke burning per unit time. The coke burning rate is then compared to the air rate to determine the relationship between the actual air rate and the stoichiometric minimum required to burn coke at that rate.

The COT controller is then placed in cascade with the heat duty controller. The air is then ramped at a predetermined rate adjusting the steam flow as required to maintain a velocity of less than 150 m/sec at all points in the coils of the furnace. The air flow rate and the steam flow rate are then each adjusted to reach a predetermined target and maintained until decoking is complete.

As described in the detailed description of preferred embodiments set forth below, process times, velocities and COT increases are provided for an exemplary embodiment of the method of the invention. Those skilled in the art will recognize that the description of preferred embodiments described herein and the temperature changes provided reflect approximate values for similar furnaces and operating plants. In actual practice, operators may have to vary the flow rates, temperatures or times to reflect the effects of various operating parameters, such as, for example, extended run length, special feedstock characteristics, severity of the operation, or process upsets which may have occurred. One skilled in the art can use the teachings set forth herein to adjust the values of the specific parameters set forth herein as necessary to achieve the desired result using COTs to monitor the progress of the decoking process.

Preferably, the methods described herein are performed manually by an operator to enable the operator to assess the initial coke burning during air introduction, during which monitoring and number/frequency of furnace adjustments are most critical. Moreover, although the method is intended to guard against and prevent overly rapid coke burn, it is generally desirable for operators to visually inspect the coils (pyrometer) from time to time during the process to detect any hot spots. However, the invention is not limited in this regard, and if desired, the method can be performed using an automatic sequence controller.

Also note that the process typically calls for use of the fuel heat duty controller in cascade with the COT controller during some of the steps to control firing based upon the COT. Other control methods can be used to control COT and/or to control firing as is known in the art.

The detailed description provided below describes the process as performed in a typical ethylene furnace. Those skilled in the art will understand that the method as described herein can be modified as necessary to be performed in ethylene furnaces having various designs.

EXAMPLE 1

Step 1. When the furnace is ready for decoking, the fuel heat duty controller is cascaded to the average COT controller. Dilution steam flow is provided to the furnace at a rate such that the flow velocity in the tube is 100 to 125 m/sec. The average COT set point should be ramped to about 40° C. to 60° C. below the final decoking temperature. The fuel firing rate is adjusted by the COT controller as necessary to maintain the COT at the desired set point. The steam flow and average COT temperature are preferably maintained as described above for about one hour.

Step 2. The fuel firing control is placed in heat duty control (i.e. QIC) by breaking the fuel heat duty controller cascade to the average COT controller. The fired heat duty is maintained constant. The steam flow rate is maintained at the same level as used in Step 1. Decoking air is added while observing the COTs for each coil. If the air flow rate is too low to obtain a reading from the flow meter, the decoking air valve positions must be used to control air flow rate. Accordingly, it is desirable to ensure that the air control valves are calibrated before each decoking procedure. The decoking air flow rate should be adjusted to raise the COT by about 10 to 30° C., preferably about 20° C., in the coil within about 30 minutes. The increase in COT that occurs during this step is due to the start of coke burning in the coils. If the maximum air flow rate (600% of the stoichiometric minimum flow rate determined as described below) is reached before the coil COT increases by about 20° C., then proceed immediately to step 4.

After the target COT is achieved in the coil, adjust (i.e. maintain, lower, or increase) the air flow rate as needed to maintain about 850° C. COT in the coil for about one (1) hour while holding the fuel firing and decoking steam flow rates constant.

Step 3. Increase the decoking air flow rate equally to each coil (again by valve position if necessary) until the COT increases by about 20° C. The air flow rate should be ramped up such that the target COT is reached within about 30 minutes. This COT is the final decoking COT and will be maintained for the remainder of the procedure unless limitations are reached on tube metallurgy in the convection or radiant section. The stoichiometric minimum air flow rate required to raise the COT by 20° C. is then calculated as is known in the art. The minimum air rate is then compared to the actual air rate. If the air rate is less than 300% of the stoichiometric minimum, the furnace is maintained at the current COT until the air reaches 300% of the minimum. If at any time during the one hour period the maximum air flow rate reaches about 600% of the stoichiometric minimum and the COTs start to drop, proceed immediately to step 4.

Step 4. At this point the decoking can be finished using well established and know methods such as ramping the air and steam rates to reach the final target values and holding until decoking is complete. The ramping steps may be based on time intervals or set based on the results of $CO_2$ analysis of the effluent as known to those skilled in the art.

EXAMPLE 2

An exemplary detailed decoking procedure for a particular four coil furnace is provided in the attached Process Description and summarized in Table 1.

It should be understood that the exemplary processes described above are not intended to limit the invention in any way and are provided only to describe specific embodiments of the method of the invention. While specific embodiments of the present invention have been described above, one skilled in the art will recognize that numerous variations or changes may be made to the process described above without departing from the scope of the invention as recited in the appended claims.

TABLE 1

Sample Decoke Procedure

| | | | Mass flow rate per furnace | | | Mass flow rate per coil | | |
|---|---|---|---|---|---|---|---|---|
| Step | Duration hours | COT | steam kg/h | air kg/h | total kg/h | steam kg/h | air kg/h | total kg/h |
| 1 | 1 | AVERAGE 830 | 12000 | 0 | 12000 | 2000 | 0 | 2000 |
| 2 | 1.5 | MAXIMUM 850 | 12000 | MAXIMUM 1900 | MAXIMUM 13900 | 2000 | MAXIMUM 317 | MAXIMUM 2317 |
| 3 | 1.5 to 2.5 | MAXIMUM 875 | 12000 | MINIMUM FINAL 960 MAXIMUM 1900 | MAXIMUM 13900 | 2000 | MINIMUM FINAL 160 MAXIMUM 317 | MAXIMUM 2317 |
| 4 | | Average Currrent COT | | | | | | |
| 5 | 1 to 3 | 870 C. 865 < Max < 885 | 12000 | 1900 | 13900 | 2000 | 317 | 2317 |
| 6 | 4 | 870 C. 865 < Max < 885 | 12000 | 4400 | 16400 | 2000 | 733 | 2733 |
| 7 | 4 | 870 C. 865 < Max < 885 | ↓ 9000 | ↓ 9000 | 18000 | ↓ 1500 | ↓ 1500 | 3000 |
| 8 | ~6 | 870 C. 865 < Max < 885 | 9000 | 9000 | 18000 | 1500 | 1500 | 3000 |
| 9 | ~1 | Setpt +10 C. 870 < Max < 890 | 9000 | 9000 | 18000 | 1500 | 1500 | 3000 |
| Total | 20-22 | | | | | | | |

| Step | Controller Status | Comments |
|---|---|---|
| 1 | Fuel/COT cascade | Steam only |
| 2 | Fuel heat duty automatic/no cascade to COT | Ramp air equally to each coil to try to achieve a COT of 850 C. in hottest coil within 30 minutes. After at least one coil is at 850 hold for one hour by controlling air flow, then go to step 3. If max air flow is reached and COTs start to drop go to step 4. |
| 3 | Fuel heat duty automatic/no cascade to COT | Ramp air equally to each coil to try to achieve a COT of 875 C. in hottest coil within 30 minutes. After at least one coil is at 875 C. hold for one hour by controlling air flow. If air flow at the end of 1 hour is less than the minimum final rate then continue to hold for another hour before going to step 4 - otherwise go directly to step 4 after the initial 1 hour hold. If max air flow is reached at any time and COTs start to drop proceed to step 4. |
| 4 | Fuel/COT cascade | Set average COT setpoint equal to the current average value. |
| 5 | Fuel/COT cascade | AVG COT SETPOINT SHOULD BE SET TO 870 C. AND IF NECESSARY ADJUSTED TO ENSURE THAT 865 C. < HOTTEST COIL < 885 C. If the air flow is already at 317 kg/h (coil) flow skip to step 6. Ramp air at 63 kg/h per coil until 317 kg/h (coil) air is reached. |
| 6 | Fuel/COT cascade | IF NECESSARY AVG COT SETPOINT SHOULD BE ADJUSTED TO ENSURE THAT 865 C. < HOTTEST COIL < 885 C. Ramp air at 104 kg/h (coil) until 733 kg/h (coil) air is reached. |
| 7 | Fuel/COT cascade | IF NECESSARY AVG COT SETPOINT SHOULD BE ADJUSTED TO ENSURE THAT 865 C. < HOTTEST COIL < 885 C. Simultaneously ramp steam down at 125 kg/h (coil) and ramp air up at 192 kg/h (coil) until both flows at 1500 kg/h (coil). |

TABLE 1-continued

| Sample Decoke Procedure | | |
|---|---|---|
| 8 | Fuel/COT cascade | IF NECESSARY AVG COT SETPOINT SHOULD BE ADJUSTED TO ENSURE THAT 865 C. < HOTTEST COIL < 885 C.<br>Hold air and steam rate until CO2 decreases to 0.1% |
| 9 | Fuel/COT cascade | Raise average COT setpoint by 10 C.<br>If CO2 increases to 0.3% or greater, hold at 880 C. until CO2 decreases to 0.1%.<br>If CO2 does not increase or increases to less than 0.3%, then decoking is finished.<br>If any COT gets above 890 C. then AVG COT SETPOINT SHOULD BE ADJUSTED TO ENSURE THAT 870 C. < HOTTEST coil < 890 C. |

We claim:

1. A method for decoking the radiant coils in an ethylene furnace comprising the steps of:

(a) providing a flow of steam and firing burners in the furnace to heat the radiant coils to achieve a predetermined average coil outlet temperature;

(b) while maintaining the steam flow rate and furnace burner firing rate constant, providing air flow to the radiant coils and adjusting the flow rate of the air to achieve a first predetermined change in the coil outlet temperature in the radiant coils; and (c) while maintaining the steam flow rate and furnace burner firing rate constant, adjusting the flow rate of the air to achieve a second predetermined change in the coil outlet temperature in the radiant coils to a decoking temperature.

2. The method of claim 1, further comprising the steps of:

(d) determining the stoichiometric minimum quantity of air required to raise the coil outlet temperature by the second predetermined change in the coil outlet temperature; and (e) comparing the stoichiometric minimum quantity of air required to raise the coil outlet temperature by the second predetermined change in the coil outlet temperature to the actual air flow rate to determine the rate of coke burning.

3. The method of claim 2, further comprising the step of:

(g) after determining the coke burning rate, adjusting further the air flow to the coils and the burner firing rate to adjust coke burning rate.

4. The method of claim 1, wherein the predetermined average coil outlet temperature is about 830° C., the first predetermined change in the coil outlet temperature is about 20° C. and the second predetermined change in the coil outlet temperature is about 20° C. such that the final decoking temperature is about 870° C.

5. The method of claim 1, wherein the steam flow rate is maintained at a rate such that the combined flow velocity of the steam and air in the radiant coils is between about 75 and 175 m/sec.

6. The method of claim 1, further comprising the steps after step (c) of:

(i) comparing the actual air flow rate to achieve the predetermined change in the coil outlet temperature in the coils to a calculated theoretical minimum to determine if spalled coke is present in the coils; and (ii) if spalled coke is determined to be present, adjusting the air flow to maintain the coil outlet temperature in the coil until the actual air flow rate reaches between about 200% to 400% of the theoretical minimum.

7. The method of claim 1, wherein the predetermined average coil outlet temperature of step (a) is maintained for a period of about one hour.

8. A method for decoking the radiant coils in an ethylene furnace comprising the steps of:

(a) providing a flow of steam and firing burners in the furnace to heat the radiant coils to achieve a predetermined average coil outlet temperature and maintaining the radiant coils at the predetermined average coil outlet temperature for a predetermined period of time;

(b) while maintaining the steam flow rate and furnace burner firing rate constant, providing air flow to the radiant coils and adjusting the flow rate of the air to achieve a first predetermined change in the coil outlet temperature in the radiant coils;

(c) maintaining the radiant coils at the coil outlet temperature achieved in step (b) for a predetermined period of time; and (d) while maintaining the steam flow rate and furnace burner firing rate constant, adjusting the air flow rate until the coil outlet temperature in the radiant coils to achieve a second predetermined change in the coil outlet temperature in the radiant coils to a decoking temperature, such that the decoking temperature is about 20° C. to 80° C. above the average coil outlet temperature in the radiant coils achieved in step (a).

9. The method of claim 8, wherein the initial predetermined average coil outlet temperature in step (a) is about 830° C., the coil outlet temperature after step (b) is about 850° C. and the decoking temperature is about 870° C.

10. The method of claim 8, further comprising the steps of:

(e) after completing step (d) and achieving the decoking temperature, comparing the stoichiometric minimum quantity of air required to raise the coil outlet temperature to the decoking temperature with the actual required air rate to determine the coke burning rate; and (f) after determining the coke burning rate, adjusting further the air flow to the coils and the burner firing rate to adjust coke burning rate.

11. The method of claim 8, wherein the steam flow rate is maintained at a rate such that the combined flow velocity of steam and air in the radiant coils is between about 75 and 175 m/sec.

12. The method of claim 8, further comprising the steps after step (d) of:

(i) comparing the actual air flow rate to achieve the predetermined coil outlet temperature in the coil to a calculated theoretical minimum to determine if spalled coke is present in the coils; and (ii) if spalled coke is determined to be present, adjusting the air flow to maintain the coil outlet temperature in the coil until the air flow rate reaches 200% to 400% of the theoretical minimum.

13. The method of claim 8, wherein the predetermined average coil temperature of step (a) is maintained for a period of about one hour.

14. A method for decoking the radiant coils in an ethylene furnace comprising the steps of:

(a) providing a flow of steam and firing burners in the furnace to heat the radiant coils to achieve an average coil outlet temperature of about 830° C. and maintaining the radiant coils at the average coil temperature of about 830° C. for about one hour;

(b) while maintaining the steam flow rate and furnace burner firing rate constant, providing air flow to the radiant coils and adjusting the flow rate of the air to achieve a coil outlet temperature in the radiant coil of about 850° C.;

(c) maintaining the coil outlet temperature in the radiant coil at about 850.degree. C. for a period of about one hour;

(d) while maintaining the steam flow rate and furnace burner firing rate constant, adjusting the air flow rate until the coil outlet temperature in the radiant coil increases to about 870° C.;

(e) determining the stoichiometric minimum quantity of air required to raise the coil outlet temperature to 870° C. and comparing this rate to the actual air flow rate to determine if spalled coke is present; and, (f) using this comparison to further adjust the air rate and burner firing rate.

* * * * *